US010191418B2

(12) United States Patent
Hadano

(10) Patent No.: US 10,191,418 B2
(45) Date of Patent: Jan. 29, 2019

(54) FIXATION APPARATUS, IMAGE FORMATION APPARATUS, METHOD OF CONTROLLING FIXATION APPARATUS, AND NON-TRANSITORY RECORDING MEDIUM STORING PROGRAM FOR CONTROLLING FIXATION APPARATUS

(71) Applicant: KONICA MINOLTA, INC., Chiyoda-ku, Tokyo (JP)

(72) Inventor: Hideki Hadano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/412,725

(22) Filed: Jan. 23, 2017

(65) Prior Publication Data

US 2017/0219973 A1 Aug. 3, 2017

(30) Foreign Application Priority Data

Jan. 28, 2016 (JP) ..... 2016-014592

(51) Int. Cl.
*G03G 15/20* (2006.01)

(52) U.S. Cl.
CPC ..... *G03G 15/2025* (2013.01)

(58) Field of Classification Search
CPC ..... G03G 15/2075
USPC ..... 399/329
See application file for complete search history.

(56) References Cited

U.S. PATENT DOCUMENTS

2006/0269334 A1* 11/2006 Takahashi ..... G03G 15/2064 399/329
2007/0059060 A1* 3/2007 Kameda ..... G03G 15/2025 399/329
2010/0316421 A1* 12/2010 Komuro ..... G03G 15/206 399/329
2011/0044737 A1* 2/2011 Takada ..... G03G 15/2025 399/329
2014/0286683 A1* 9/2014 Nakamura ..... G03G 15/2053 399/329

FOREIGN PATENT DOCUMENTS

JP 2008185882 A 8/2008

* cited by examiner

*Primary Examiner* — Quana M Grainger
(74) *Attorney, Agent, or Firm* — Holtz, Holtz & Volek PC

(57) ABSTRACT

A fixation apparatus includes a rotatable fixation belt, a pressurization roller which is in contact with an outer circumferential surface of the fixation belt and rotates the fixation belt, a pressing member which is provided to face the pressurization roller with the fixation belt being interposed and presses the fixation belt against the pressurization roller, a heating roller which provides heat to paper which passes through a portion of contact between the fixation belt and the pressurization roller by providing heat to the fixation belt, and an adjustment mechanism for adjusting an amount of attachment of a lubricant to an inner circumferential surface of the fixation belt. The adjustment mechanism adjusts the amount of attachment of the lubricant such that an amount of attachment of the lubricant while the fixation belt remains stopped is smaller than an amount of attachment of the lubricant during rotation of the fixation belt.

15 Claims, 10 Drawing Sheets

FIXATION APPARATUS, IMAGE FORMATION APPARATUS, METHOD OF CONTROLLING FIXATION APPARATUS, AND NON-TRANSITORY RECORDING MEDIUM STORING PROGRAM FOR CONTROLLING FIXATION APPARATUS

This application is based on Japanese Patent Application No. 2016-014592 filed with the Japan Patent Office on Jan. 28, 2016, the entire content of which is hereby incorporated by reference.

BACKGROUND OF THE INVENTION

Field of the Invention

The present disclosure relates to control of a fixation apparatus included in an image formation apparatus of an electrophotography type.

Description of the Related Art

An image formation apparatus of an electrophotography type has widely been used. An image formation apparatus of an electrophotography type fixes a transferred toner image onto paper with heat. The step of fixing a toner image onto paper is performed by a fixation apparatus.

A fixation apparatus includes a fixation belt, a pressurization roller, a pressing member, and a heating roller. The fixation belt is looped around the heating roller and the pressing member. The fixation belt is in contact with the pressurization roller and rotationally driven by the pressurization roller. The pressing member presses the fixation belt against the pressurization roller. A nip region is thus formed between the fixation belt and the pressurization roller. The heating roller provides through the fixation belt, heat to paper which passes through the nip region. Consequently, the toner image is molten on the paper and fixed to the paper.

When a slide resistance between the fixation belt and the pressing member is high, rotation of the fixation belt is interfered, which results in increase in drive torque of the fixation belt and failure in transportation of paper and misalignment in printing. Lowering in slide resistance between the fixation belt and the pressing member with the use of a lubricant has been known as a method of solving such a problem. Too large an amount of lubricant, however, results in leakage of the lubricant from the fixation belt. In connection with a technique for preventing leakage of a lubricant, for example, Japanese Laid-Open Patent Publication No. 2008-185882 discloses a fixation apparatus capable of recovering a lubricant supplied to a fixation belt.

The fixation apparatus disclosed in Japanese Laid-Open Patent Publication No. 2008-185882 controls an amount of supply and an amount of recovery of a lubricant such that an amount of attachment of the lubricant to a fixation belt is always constant. Even while the fixation apparatus is not operating, the lubricant is attached to the fixation belt. The lubricant is cured as a temperature is lower. As the lubricant is cured, a slide resistance between the fixation belt and the pressing member becomes high. Therefore, in the fixation apparatus disclosed in Japanese Laid-Open Patent Publication No. 2008-185882, torque at the time of start of rotation of the fixation belt increases, which results in failure in transportation of paper or misalignment in printing.

SUMMARY OF THE INVENTION

The present disclosure was made to solve the problems as described above, and an object in one aspect is to provide a fixation apparatus capable of preventing increase in slide resistance of a fixation belt due to curing of a lubricant. An object in another aspect is to provide an image formation apparatus capable of preventing increase in slide resistance of a fixation belt due to curing of a lubricant. An object in yet another aspect is to provide a method of controlling a fixation apparatus capable of preventing increase in slide resistance of a fixation belt due to curing of a lubricant. An object in still another aspect is to provide a non-transitory recording medium storing a program for controlling a fixation apparatus capable of preventing increase in slide resistance of a fixation belt due to curing of a lubricant.

According to one aspect, a fixation apparatus configured to fix a toner image transferred to paper to the paper with heat includes a rotatable belt, a pressurization roller configured to be in contact with an outer circumferential surface of the belt and to rotate the belt, a pressing member configured to face the pressurization roller with the belt being interposed and to press the belt against the pressurization roller, a heating roller configured to provide heat to the paper which passes through a portion of contact between the belt and the pressurization roller by providing heat to the belt, and an adjustment mechanism configured to adjust an amount of attachment of a lubricant to an inner circumferential surface of the belt. The adjustment mechanism is configured to adjust an amount of attachment of the lubricant to the inner circumferential surface of the belt such that an amount of attachment of the lubricant while the belt remains stopped is smaller than an amount of attachment of the lubricant during rotation of the belt.

Preferably, the adjustment mechanism recovers the lubricant attached to the inner circumferential surface of the belt before the belt stops rotation.

Preferably, the adjustment mechanism supplies the lubricant to the inner circumferential surface of the belt based on start of rotation of the belt.

Preferably, the adjustment mechanism recovers the lubricant supplied to the inner circumferential surface of the belt such that the lubricant does not remain in the portion of contact when the belt stops rotation.

Preferably, a first distance is shorter than a second distance, where a length of the belt on a side of a direction of rotation between a portion of contact between the adjustment mechanism and the belt and a portion of contact between the pressing member and the belt is defined as the first distance and a length of the belt on a side of a direction of reverse rotation between the portion of contact between the adjustment mechanism and the belt and the portion of contact between the pressing member and the belt is defined as the second distance.

Preferably, the adjustment mechanism includes a holding mechanism configured to hold the lubricant and an adjustment roller configured to be in contact with the lubricant and the inner circumferential surface of the belt and to rotate in a direction the same as the belt in a portion of contact with the inner circumferential surface of the belt. The adjustment roller supplies the lubricant to the inner circumferential surface of the belt by rotating faster than the belt and recovers the lubricant supplied to the inner circumferential surface of the belt by rotating slower than the belt.

Preferably, the adjustment roller recovers the lubricant supplied to the inner circumferential surface of the belt by stopping rotation.

Preferably, the adjustment roller contains a heat source.

Preferably, the heat source heats the lubricant before the belt starts rotation.

According to another aspect, an image formation apparatus including the fixation apparatus described above is provided.

According to yet another aspect, a method of controlling a fixation apparatus configured to fix a toner image transferred to paper to the paper with heat is provided. The fixation apparatus includes a rotatable belt, a pressurization roller configured to be in contact with an outer circumferential surface of the belt and to rotate the belt, a pressing member configured to face the pressurization roller with the belt being interposed and to press the belt against the pressurization roller, and a heating roller configured to provide heat to the paper which passes through a portion of contact between the belt and the pressurization roller by providing heat to the belt. The method includes supplying the lubricant to an inner circumferential surface of the belt based on start of rotation of the belt and recovering the lubricant supplied to the inner circumferential surface of the belt before the belt stops rotation.

Preferably, a non-transitory recording medium storing a control program performing the method above is provided.

Preferably, the recovering the lubricant includes recovering the lubricant supplied to the inner circumferential surface of the belt such that the lubricant does not remain in the portion of contact when the belt stops rotation.

Preferably, the fixation apparatus further includes an adjustment mechanism configured to adjust an amount of attachment of the lubricant to the inner circumferential surface of the belt. A first distance is shorter than a second distance, where a length of the belt on a side of a direction of rotation between a portion of contact between the adjustment mechanism and the belt and a portion of contact between the pressing member and the belt is defined as the first distance and a length of the belt on a side of a direction of reverse rotation between the portion of contact between the adjustment mechanism and the belt and the portion of contact between the pressing member and the belt is defined as the second distance.

Preferably, the fixation apparatus further includes a holding mechanism configured to hold the lubricant and an adjustment roller configured to be in contact with the lubricant and the inner circumferential surface of the belt and to rotate in a direction the same as the belt in a portion of contact with the inner circumferential surface of the belt. The supplying the lubricant includes supplying the lubricant to the inner circumferential surface of the belt by rotating the adjustment roller faster than the belt. The recovering the lubricant includes recovering the lubricant supplied to the inner circumferential surface of the belt by rotating the adjustment roller slower than the belt.

Preferably, the recovering the lubricant includes recovering the lubricant supplied to the inner circumferential surface of the belt by stopping rotation.

Preferably, the adjustment roller contains a heat source.

Preferably, the heat source heats the lubricant before the belt starts rotation.

Preferably, the fixation apparatus is mounted on an image formation apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
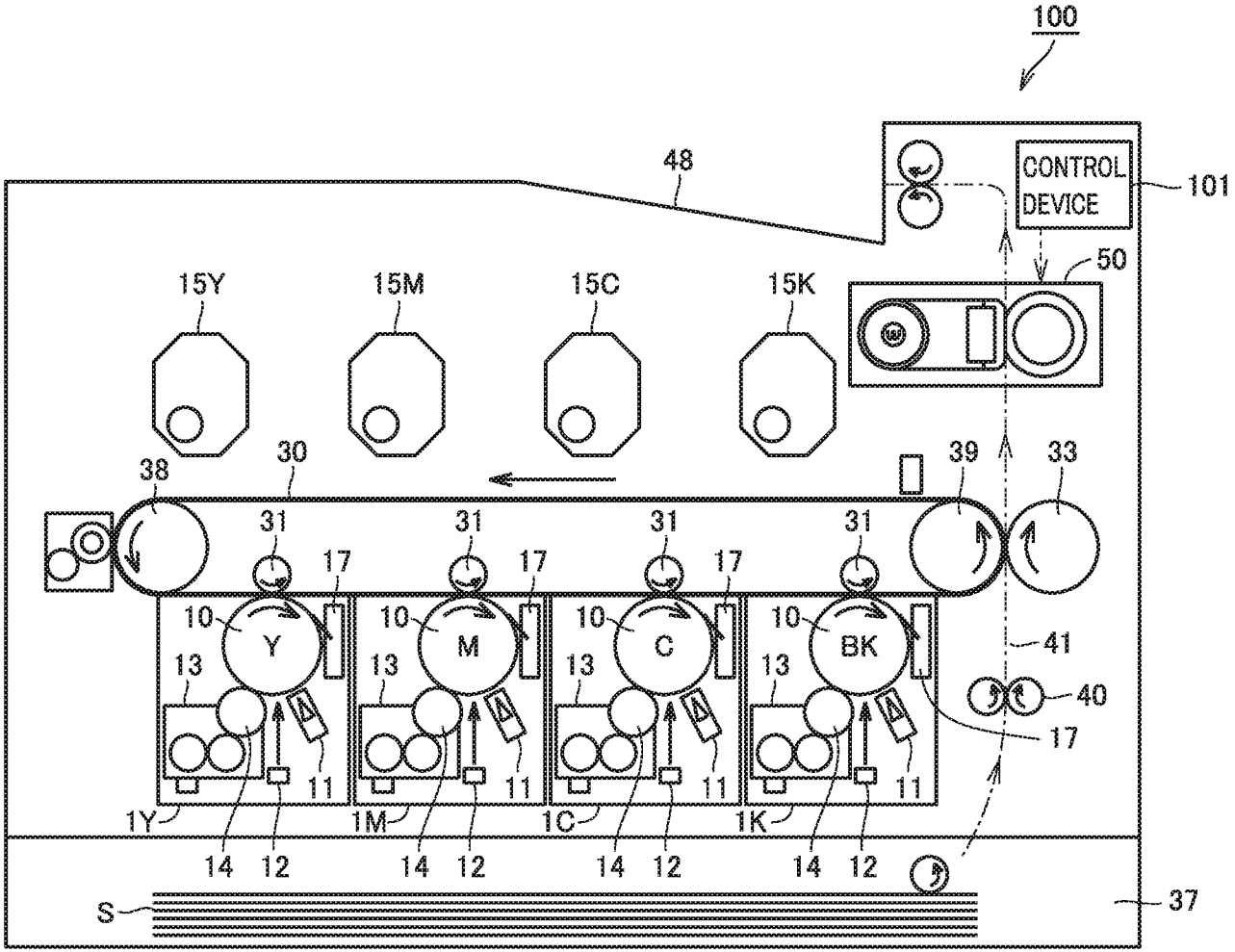
FIG. 1 is a diagram showing one example of an internal structure of an image formation apparatus according to a first embodiment.

Each embodiment according to the present invention will be described hereinafter with reference to the drawings. The same elements and components in the description below have the same reference characters allotted. Their label and function are also identical. Therefore, detailed description thereof will not be repeated. Each embodiment and each modification described below may selectively be combined as appropriate.

First Embodiment

[Internal Structure of Image Formation Apparatus 100]

An image formation apparatus 100 on which a fixation apparatus 50 described above is mounted will be described with reference to FIG. 1. FIG. 1 is a diagram showing one example of an internal structure of image formation apparatus 100.

FIG. 1 shows image formation apparatus 100 as a color printer. Though image formation apparatus 100 as the color printer is described below, image formation apparatus 100 is not limited to the color printer. For example, image formation apparatus 100 may be a monochrome printer, a facsimile machine, or a multi-functional peripheral (MFP) of a monochrome printer, a color printer, and a facsimile machine as being combined.

Image formation apparatus 100 includes image formation units 1Y, 1M, 1C, and 1K, an intermediate transfer belt 30, a primary transfer roller 31, a secondary transfer roller 33, a cassette 37, a driven roller 38, a drive roller 39, a timing roller 40, fixation apparatus 50, and a control device 101.

Image formation units 1Y, 1M, 1C, and 1K are sequentially aligned along intermediate transfer belt 30. Image formation unit 1Y forms a toner image of yellow (Y) upon receiving supply of toner from a toner bottle 15Y. Image formation unit 1M forms a toner image of magenta (M) upon receiving supply of toner from a toner bottle 15M. Image formation unit 1C forms a toner image of cyan (C) upon receiving supply of toner from a toner bottle 15C. Image formation unit 1K forms a toner image of black (BK) upon receiving supply of toner from a toner bottle 15K.

Image formation units 1Y, 1M, 1C, and 1K are arranged sequentially in a direction of rotation of intermediate transfer belt 30 along intermediate transfer belt 30. Each of image formation units 1Y, 1M, 1C, and 1K includes a photoconductor 10, a charging apparatus 11, an exposure apparatus 12, a development apparatus 13, and a cleaning apparatus 17.

Charging apparatus 11 evenly charges a surface of photoconductor 10. Exposure apparatus 12 irradiates photoconductor 10 with laser beams in response to a control signal from control device 101 and exposes the surface of photoconductor 10 in accordance with an input image pattern. An electrostatic latent image in accordance with an input image is thus formed on photoconductor 10.

Development apparatus 13 applies a development bias to a development roller 14 while it rotates development roller 14, to thereby attach toner onto a surface of development roller 14. The toner is thus transferred from development roller 14 to photoconductor 10 and a toner image in accordance with the electrostatic latent image is developed on the surface of photoconductor 10.

Photoconductor 10 and intermediate transfer belt 30 are in contact with each other at a portion where primary transfer roller 31 is provided. Primary transfer roller 31 is in a shape of a roller and configured to be rotatable. A transfer bias opposite in polarity to the toner image is applied to primary transfer roller 31 so that the toner image is transferred from photoconductor 10 to intermediate transfer belt 30. The toner image of yellow (Y), the toner image of magenta (M), the toner image of cyan (C), and the toner image of black (BK) are successively layered and transferred from photoconductor 10 to intermediate transfer belt 30. The color toner image is thus formed on intermediate transfer belt 30.

Intermediate transfer belt 30 is looped around driven roller 38 and drive roller 39. Drive roller 39 is rotationally driven, for example, by a motor (not shown). Intermediate transfer belt 30 and driven roller 38 rotate in coordination with drive roller 39. A toner image on intermediate transfer belt 30 is thus transported to secondary transfer roller 33.

Cleaning apparatus 17 is pressed against photoconductor 10 as being in contact therewith. Cleaning apparatus 17 recovers toner which remains on the surface of photoconductor 10 after transfer of the toner image.

Paper S is set in cassette 37. Paper S is sent from cassette 37 to secondary transfer roller 33 one by one along a transportation path 41 by timing roller 40. Secondary transfer roller 33 is in a shape of a roller and configured to be rotatable. Secondary transfer roller 33 applies a transfer voltage opposite in polarity to the toner image to transported paper S. The toner image is thus attracted from intermediate transfer belt 30 to secondary transfer roller 33 and the toner image on intermediate transfer belt 30 is transferred. Timing of transportation of paper S to secondary transfer roller 33 is adjusted by timing roller 40 in accordance with a position of the toner image on intermediate transfer belt 30. Owing to timing roller 40, the toner image on intermediate transfer belt 30 is transferred to an appropriate position on paper S.

Fixation apparatus 50 pressurizes and heats paper S which passes therethrough. The toner image is thus fixed onto paper S. Thereafter, paper S is ejected onto a tray 48.

Though image formation apparatus 100 adopting a tandem system as a printing method has been described above, a printing method of image formation apparatus 100 is not limited to the tandem system. Arrangement of each feature in image formation apparatus 100 can be modified as appropriate in accordance with an adopted printing method. A rotary system or a direct transfer system may be adopted as the printing method of image formation apparatus 100. In the rotary system, image formation apparatus 100 is constituted of a single photoconductor 10 and a plurality of development apparatuses 13 configured to be rotatable on the same axis. Image formation apparatus 100 sequentially guides each development apparatus 13 to photoconductor 10 during printing and develops a toner image of each color. In the direct transfer system, image formation apparatus 100 directly transfers a toner image formed on photoconductor 10 onto paper S.

[Internal Structure of Fixation Apparatus 50]

Figure 2:
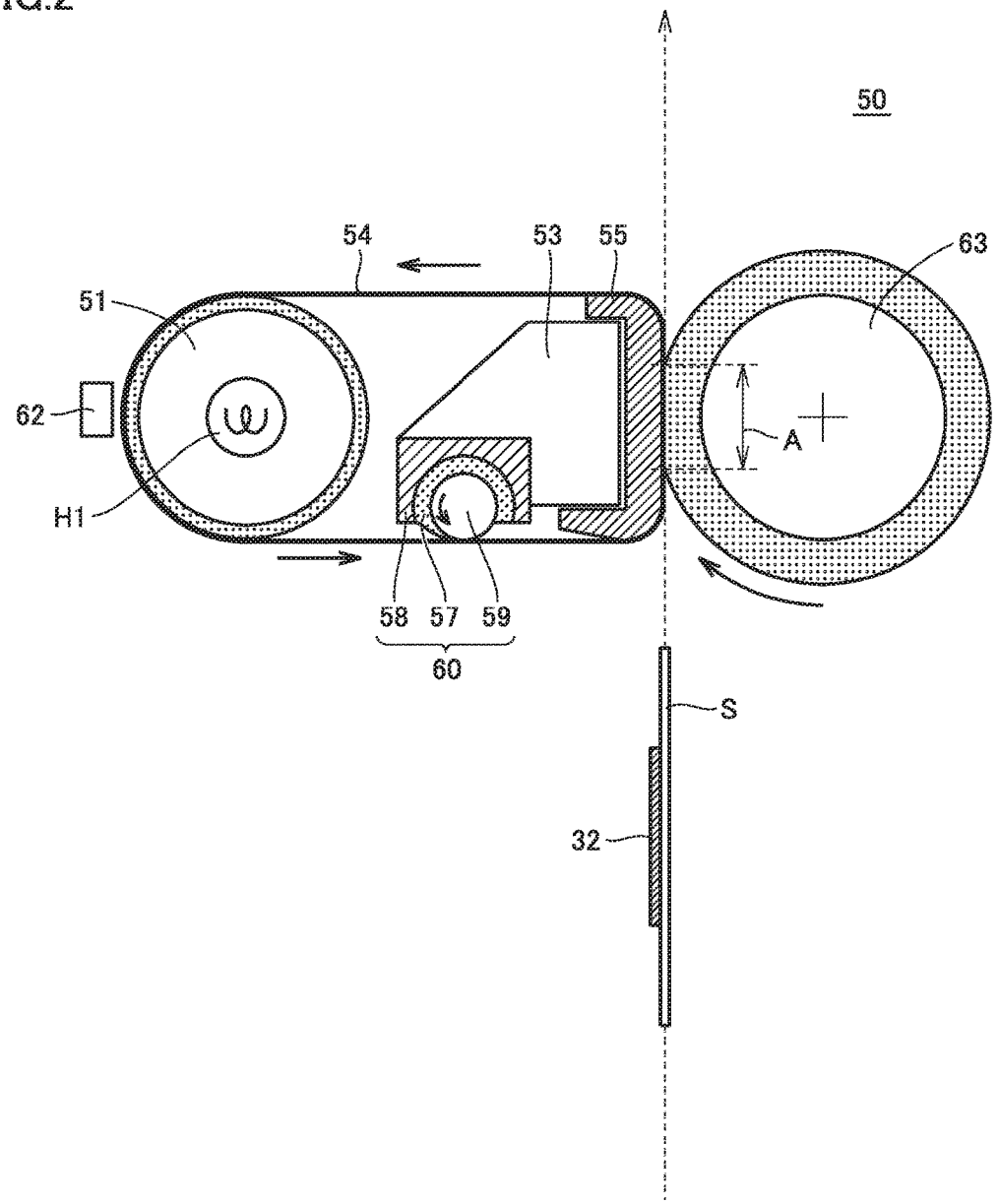
FIG. 2 is a diagram showing an internal structure of a fixation apparatus according to the first embodiment.

Fixation apparatus 50 shown in FIG. 1 will further be described with reference to FIG. 2. FIG. 2 is a diagram showing an internal structure of fixation apparatus 50.

As shown in FIG. 2, fixation apparatus 50 includes a heating roller 51, a fixing member 53, a fixation belt 54, a pressing member 55, an adjustment mechanism 60, a thermistor 62, and a pressurization roller 63.

Heating roller 51 is heated by a heater H1 and transmits heat received from heater H1 to fixation belt 54. Heating roller 51 has an outer diameter, for example, from 20 mm to 30 mm. Heating roller 51 is constituted, for example, of a core metal and a surface layer. The core metal is made of aluminum or iron and is in a shape of a pipe. The core metal has a thickness, for example, from 0.2 mm to 1 mm. The surface layer of heating roller 51 is formed around an outer circumferential surface of the core metal. Preferably, PTF resistant to heat and wear is applied to the surface layer of heating roller 51.

Fixation belt 54 is a flexible endless belt. Fixation belt 54 is looped around heating roller 51 and pressing member 55 and configured to be rotatable. Fixation belt 54 transmits heat received from heating roller 51 to a nip region A which is a portion of contact between fixation belt 54 and pressurization roller 63 as it rotates. As paper S passes through nip region A, a toner image 32 is molten on paper S and fixed to paper S.

Fixation belt 54 is formed, for example, of a base layer and an elastic layer. The base layer of fixation belt 54 is formed from a polyimide film. The base layer of fixation belt 54 has an inner diameter of 50 mm, a width of 330 mm, and a thickness of 70 μm. The elastic layer of fixation belt 54 is composed of silicone rubber. The elastic layer of fixation belt 54 has a thickness, for example, from 100 μm to 200 μm. A surface of fixation belt 54 may be coated with fluorine. A thickness of fluorine for coating is, for example, 30 μm.

Pressing member 55 is provided to face pressurization roller 63 with fixation belt 54 being interposed. Pressing member 55 is fixed to fixing member 53 so as to press fixation belt 54 against pressurization roller 63. The elastic layer of pressurization roller 63 thus deforms so that nip region A is formed between fixation belt 54 and pressurization roller 63. Pressing member 55 is longer than a width of paper S in an axial direction of heating roller 51. By way of example, pressing member 55 is composed of a resin such as polyphenylene sulfide, polyimide, or a liquid crystal polymer.

Adjustment mechanism 60 adjusts an amount of attachment of a lubricant 57 to an inner circumferential surface of fixation belt 54. Adjustment mechanism 60 has a function to supply lubricant 57 to the inner circumferential surface of fixation belt 54 and to recover lubricant 57 supplied to the inner circumferential surface of fixation belt 54. As lubricant 57 is supplied to the inner circumferential surface of fixation belt 54, a slide resistance between fixation belt 54 and pressing member 55 lowers. Consequently, torque of fixation belt 54 lowers and failure in transportation of paper S or misalignment in printing is rectified.

A mechanism for supplying lubricant 57 and a mechanism for recovering lubricant 57 may separately be provided or may integrally be provided as shown in FIG. 2. FIG. 2 shows an example in which a mechanism for supplying lubricant 57 and a mechanism for recovering lubricant 57 are integrally provided.

More specifically, adjustment mechanism 60 includes a holding mechanism 58 and an adjustment roller 59. Holding mechanism 58 holds lubricant 57. Lubricant 57 is, for example, grease. Adjustment roller 59 is in contact with the inner circumferential surface of fixation belt 54 and lubricant 57. Adjustment roller 59 rotates in a direction the same as fixation belt 54 at a portion of contact with fixation belt 54. Fixation belt 54 and adjustment roller 59 rotate counterclockwise. Adjustment roller 59 supplies lubricant 57 to the inner circumferential surface of fixation belt 54 by rotating faster than fixation belt 54. Adjustment roller 59 recovers lubricant 57 supplied to the inner circumferential surface of fixation belt 54 by rotating slower than fixation belt 54. As adjustment roller 59 rotates slower than fixation belt 54, lubricant 57 is held back by adjustment roller 59. Lubricant 57 thus returns to holding mechanism 58.

Preferably, adjustment roller 59 recovers lubricant 57 supplied to the inner circumferential surface of fixation belt 54 by stopping rotation. Efficiency in recovery of lubricant 57 is thus further improved. Adjustment roller 59 may recover lubricant 57 from the inner circumferential surface of fixation belt 54 by rotating in a reverse direction at the portion of contact with fixation belt 54.

Adjustment roller 59 is made, for example, of a metal. Alternatively, adjustment roller 59 is made of a heat resistant resin. A surface layer of adjustment roller 59 is formed from an elastic layer composed, for example, of silicone rubber. Preferably, a plurality of grooves are provided in a surface of adjustment roller 59 along an axial direction of adjustment roller 59. Efficiency in supply and recovery of lubricant 57 is thus improved.

Thermistor 62 is provided to face an outer circumferential surface of heating roller 51 with fixation belt 54 being interposed. Thermistor 62 senses a temperature of heating roller 51. Image formation apparatus 100 controls heater H1 such that a temperature sensed by thermistor 62 attains to a target temperature. More specifically, image formation apparatus 100 stops heating by heater H1 when a temperature sensed by thermistor 62 is equal to or higher than the target temperature and starts heating by heater H1 when a sensed temperature is lower than the target temperature.

Pressurization roller 63 is in contact with the outer circumferential surface of fixation belt 54. Pressurization roller 63 has an outer diameter, for example, approximately from 20 mm to 40 mm. Pressurization roller 63 rotates as being driven by a motor (not shown). As pressurization roller 63 rotates, rotational force of pressurization roller 63 is transmitted to fixation belt 54. Fixation belt 54 thus rotates as following rotation of pressurization roller 63.

Pressurization roller 63 is constituted, for example, of a core metal, an intermediate layer, and a surface layer. The core metal is made of aluminum or iron. The core metal has a thickness, for example, approximately from 1 mm to 5 mm. The intermediate layer of pressurization roller 63 is formed from a heat resistant elastic body. For example, silicone rubber or a silicon sponge is adopted as the elastic body. The intermediate layer of pressurization roller 63 has a thickness, for example, approximately from 1 mm to 10 mm. A releasable material is employed for the surface layer of pressurization roller 63. For example, a fluorine tube is employed as a material for the surface layer of pressurization roller 63. The surface layer of pressurization roller 63 has a thickness, for example, from 5 μm to 100 μm.

Preferably, a slide sheet (not shown) is provided between pressing member 55 and the inner circumferential surface of fixation belt 54. The slide sheet enhances slidability between pressing member 55 and fixation belt 54. For example, a glass cloth is adopted as the slide sheet, and a surface of the glass cloth is coated with fluorine. Heat resistance, wear resistance, and slidability of the slide sheet are thus improved.

[Adjustment of Amount of Attachment of Lubricant]

Adjustment mechanism 60 adjusts an amount of attachment of lubricant 57 to the inner circumferential surface of fixation belt 54 such that an amount of attachment of lubricant 57 while fixation belt 54 remains stopped is smaller than an amount of attachment of lubricant 57 during rotation of fixation belt 54. Thus, lubricant 57 at the time of start of rotation of fixation belt 54 is smaller in amount than during rotation of fixation belt 54. Consequently, fixation apparatus 50 can prevent a slide resistance between fixation belt 54 and pressing member 55 (see FIG. 2) from increasing due to curing of lubricant 57. Since an amount of attachment of lubricant 57 during rotation of fixation belt 54 is greater than while fixation belt 54 is not rotating, a slide resistance between fixation belt 54 and pressing member 55 becomes low during rotation of fixation belt 54. Rotation of fixation belt 54 is thus stabilized and failure in transportation of paper S or misalignment in printing is rectified.

Figure 3:
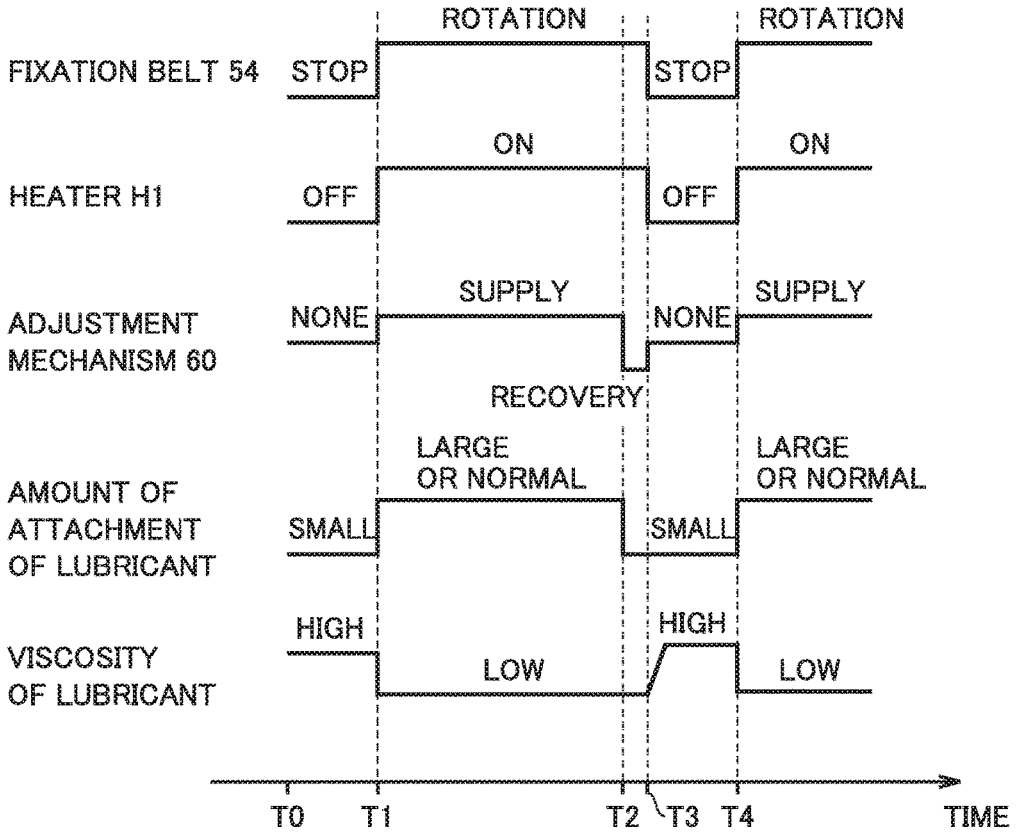
FIG. 3 is a diagram for illustrating timing of supply and timing of recovery of a lubricant.

Timing of control of adjustment mechanism 60 (see FIG. 2) will be described below with reference to FIG. 3. FIG. 3 is a diagram for illustrating timing of supply and timing of recovery of lubricant 57 (see FIG. 2). FIG. 3 shows timing of control of fixation belt 54 (see FIG. 2), timing of control of heater H1 (see FIG. 2), timing of control of adjustment mechanism 60, transition of an amount of attachment of lubricant 57 to fixation belt 54, and transition of a viscosity of lubricant 57.

At time T0, fixation apparatus 50 has rotation of fixation belt 54 stopped. Adjustment mechanism 60 does not supply and recover lubricant 57 while fixation belt 54 is not rotating.

At time T1, image formation apparatus 100 (FIG. 1) accepts a print instruction. Based thereon, fixation apparatus 50 (see FIG. 2) starts rotation of fixation belt 54. At the same time, fixation apparatus 50 starts heating by heater H1. Heat is thus transferred from heater H1 to fixation belt 54. Adjustment mechanism 60 supplies lubricant 57 to the inner circumferential surface of fixation belt 54 based on start of rotation of fixation belt 54. As lubricant 57 is supplied, a slide resistance between fixation belt 54 and pressing member 55 lowers.

At time T2, print processing in image formation apparatus 100 ends. Adjustment mechanism 60 recovers lubricant 57 attached to the inner circumferential surface of fixation belt 54 before rotation of fixation belt 54 stops. By way of example, a process for recovering lubricant 57 is performed during a prescribed period immediately before rotation of fixation belt 54 stops. As lubricant 57 is recovered before rotation of fixation belt 54 stops, lubricant 57 is prevented from being cured while fixation belt 54 remains stopped.

Preferably, adjustment mechanism 60 recovers lubricant 57 supplied to the inner circumferential surface of fixation belt 54 such that lubricant 57 does not remain in the portion of contact between fixation belt 54 and pressing member 55

(that is, nip region A (see FIG. 2)) while fixation belt 54 is not rotating. Adjustment mechanism 60 does not have to have fixation belt 54 once circulate only for recovering lubricant 57. Adjustment mechanism 60 should only rotate fixation belt 54 at least from adjustment mechanism 60 to pressing member 55.

Further preferably, adjustment mechanism 60 is provided in the vicinity of the portion of contact between fixation belt 54 and pressing member 55 on an upstream side in the direction of rotation of fixation belt 54. More specifically, a first distance is shorter than a second distance, where a length of fixation belt 54 on the side of the direction of rotation between the portion of contact between adjustment mechanism 60 and fixation belt 54 and a portion of contact between pressing member 55 and fixation belt 54 is defined as the first distance and a length of fixation belt 54 on the side of a direction of reverse rotation between the portion of contact between adjustment mechanism 60 and fixation belt 54 and the portion of contact between pressing member 55 and fixation belt 54 is defined as the second distance. Adjustment mechanism 60 can thus recover lubricant 57 by circulating the fixation belt halfway around or less.

At time T3, the process for recovery of lubricant 57 by adjustment mechanism 60 ends. Based on the end of the process for recovery of lubricant 57, fixation apparatus 50 stops rotation of fixation belt 54. At the same time, fixation apparatus 50 stops heating by heater H1. Consequently, a temperature of lubricant 57 gradually lowers and the viscosity of lubricant 57 gradually becomes high.

At time T4, image formation apparatus 100 accepts a new print instruction. Based thereon, fixation apparatus 50 starts rotation of fixation belt 54. Though the viscosity of lubricant 57 has become high by this time, lubricant 57 has been recovered during a period from time T2 to T3, and hence a slide resistance of fixation belt 54 does not increase due to curing of lubricant 57. Therefore, fixation apparatus 50 can have suppressed drive torque at the time of start of next rotation of fixation belt 54.

[Control Structure of Image Formation Apparatus 100]

Figure 4:
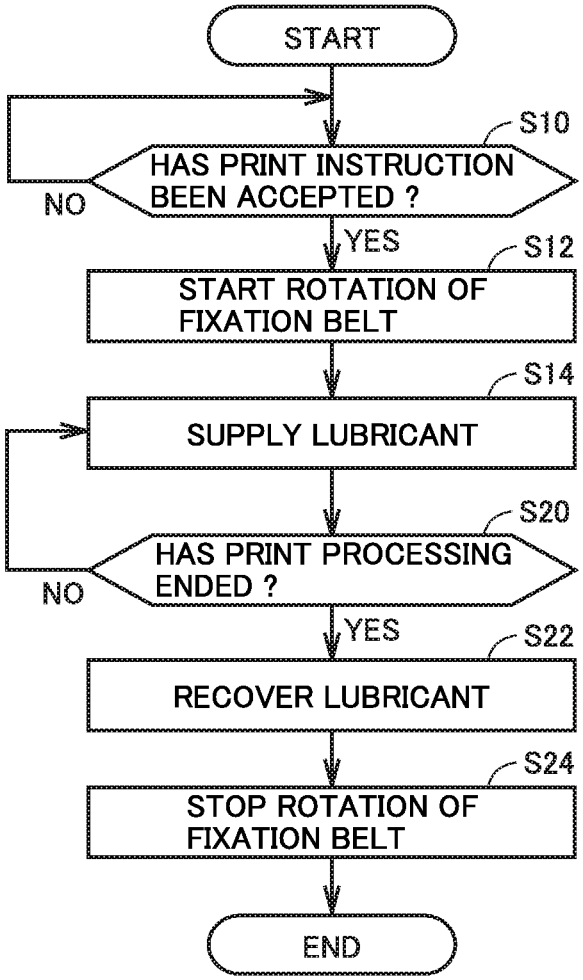
FIG. 4 is a flowchart showing a part of processing performed by the image formation apparatus according to the first embodiment.

A control structure of image formation apparatus 100 will be described with reference to FIG. 4. FIG. 4 is a flowchart showing a part of processing performed by image formation apparatus 100. A process in FIG. 4 is implemented by execution of a program by control device 101 (see FIG. 5) of image formation apparatus 100. In another aspect, a part or the entirety of the process may be performed by a circuit element or other hardware.

In step S10, control device 101 determines whether or not a print instruction has been accepted. When control device 101 determines that a print instruction has been accepted (YES in step S10), it switches control to step S12. Otherwise (NO in step S10), control device 101 performs the processing in step S10 again.

In step S12, control device 101 starts rotation of fixation belt 54 (see FIG. 2). The processing in step S12 may be performed before or simultaneously with processing in step S14.

In step S14, control device 101 performs processing for supplying lubricant 57 (see FIG. 2) to the inner circumferential surface of fixation belt 54. The processing for supplying lubricant 57 is started, for example, based on start of rotation of fixation belt 54.

In step S20, control device 101 determines whether or not the print processing has ended. When control device 101 determines that the print processing has ended (YES in step S20), it switches control to step S22. Otherwise (NO in step S20), control device 101 returns control to step S14.

In step S22, control device 101 performs processing for recovering lubricant 57 supplied to the inner circumferential surface of fixation belt 54. The processing for recovering lubricant 57 is performed before rotation of fixation belt 54 stops.

In step S24, control device 101 stops rotation of fixation belt 54. The fixation belt is rotated after lubricant 57 is recovered.

[Hardware Configuration of Image Formation Apparatus 100]

Figure 5:
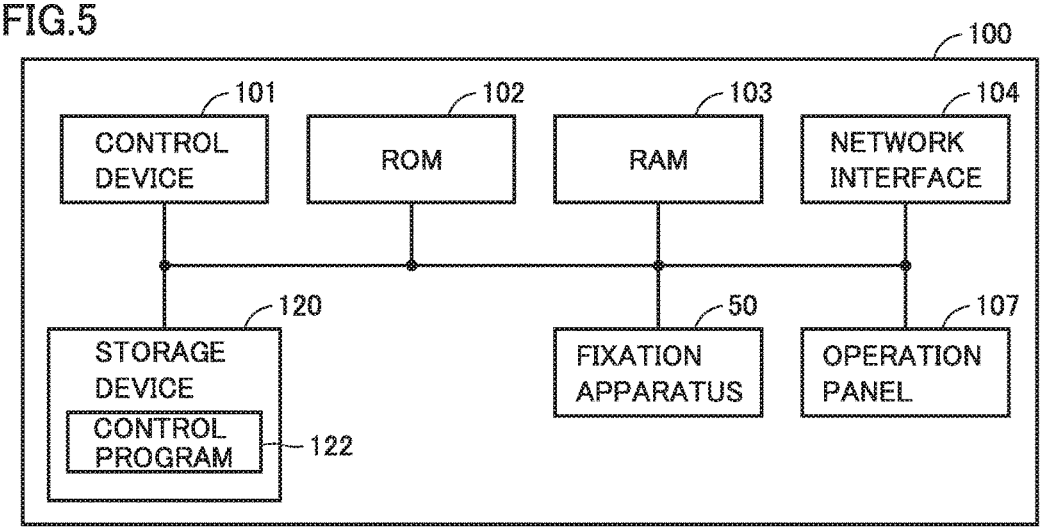
FIG. 5 is a block diagram showing a main hardware configuration of the image formation apparatus according to the first embodiment.

One example of a hardware configuration of image formation apparatus 100 will be described with reference to FIG. 5. FIG. 5 is a block diagram showing a main hardware configuration of image formation apparatus 100.

As shown in FIG. 5, image formation apparatus 100 includes fixation apparatus 50, control device 101, a read only memory (ROM) 102, a random access memory (RAM) 103, a network interface 104, an operation panel 107, and a storage device 120.

Control device 101 is implemented, for example, by at least one integrated circuit. The integrated circuit is implemented, for example, by at least one central processing unit (CPU), at least one application specific integrated circuit (ASIC), at least one field programmable gate array (FPGA), or combination thereof.

Control device 101 controls operations of image formation apparatus 100 by executing various programs such as a control program 122 according to the present embodiment. Control device 101 reads control program 122 from storage device 120 to ROM 102 based on acceptance of an instruction to execute control program 122. RAM 103 functions as a working memory and temporarily stores various types of data necessary for execution of control program 122.

An antenna (not shown) or the like is connected to network interface 104. Image formation apparatus 100 exchanges data with external communication equipment through the antenna. External communication equipment includes, for example, a portable communication terminal such as a smartphone and a server. Image formation apparatus 100 may be configured to be able to download control program 122 from a server through the antenna.

Operation panel 107 is implemented by a display and a touch panel. The display and the touch panel are layered on each other and operation panel 107 accepts, for example, a printing operation or a scanning operation onto image formation apparatus 100.

Storage device 120 is, for example, a storage medium such as a hard disk or an external storage device. Storage device 120 stores control program 122 according to the present embodiment. A location where control program 122 is stored is not limited to storage device 120, and control program 122 may be stored in a storage area of control device 101 (for example, a cache), ROM 102, RAM 103, or external equipment (for example, a server).

Control program 122 may be provided not as a program alone but as being incorporated as a part of any program. In this case, the control process according to the present embodiment is implemented in cooperation with any program. Even a program not including some modules as such does not depart from the gist of control program 122 according to the present embodiment. Some or all of functions provided by control program 122 may be implemented by dedicated hardware. Image formation apparatus 100 may be configured in such a form as what is called a cloud service in which at least one server implements some of the process of control program 122.

[Summary]

(Comparison Result 1)

Figure 6:
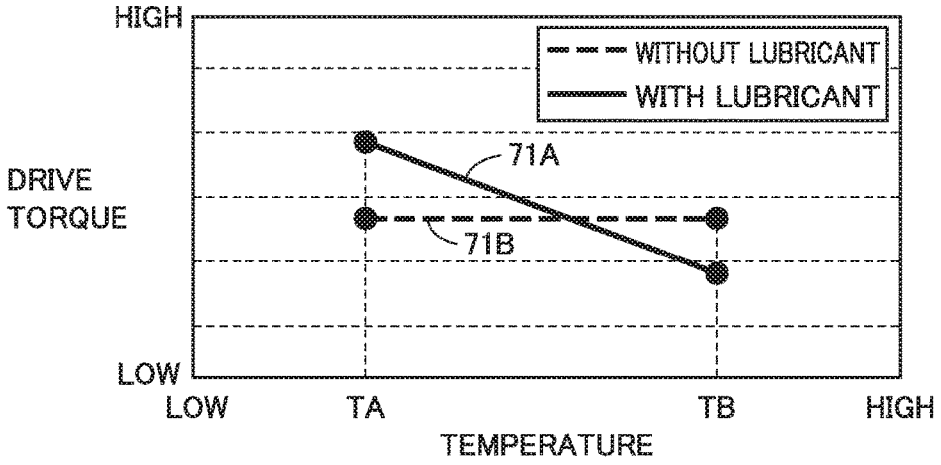
FIG. 6 is a diagram showing relation between a temperature of the lubricant and torque while a fixation belt is driven.

Advantages of fixation apparatus 50 according to the present embodiment will be described with reference to FIG. 6. FIG. 6 is a diagram showing relation between a temperature of lubricant 57 (see FIG. 2) and torque while fixation belt 54 (see FIG. 2) is driven (hereinafter also referred to as "drive torque").

A comparison result 71A shown in FIG. 6 shows relation between a temperature of lubricant 57 and drive torque in an example where lubricant 57 is applied to the inner circumferential surface of fixation belt 54. A comparison result 71B shown in FIG. 6 shows relation between a temperature of lubricant 57 and drive torque in an example where no lubricant 57 is applied to the inner circumferential surface of fixation belt 54.

As shown in comparison result 71A, with lubricant 57 being applied, as a temperature of lubricant 57 is lower, drive torque of fixation belt 54 is higher. On the other hand, as shown in comparison result 71B, with no lubricant 57 being applied, drive torque of fixation belt 54 is constant regardless of a temperature of lubricant 57. At a temperature TB, drive torque with lubricant 57 being applied is lower than drive torque with no lubricant 57 being applied. At a temperature TA, however, drive torque with lubricant 57 being applied is higher than drive torque with no lubricant 57 being applied. When a temperature of lubricant 57 is low, lubricant 57 is cured and drive torque of fixation belt 54 increases.

Fixation apparatus 50 according to the present embodiment recovers lubricant 57 from the inner circumferential surface of fixation belt 54 before rotation of fixation belt 54 stops. Therefore, fixation apparatus 50 can achieve suppression of increase in drive torque of fixation belt 54 due to curing of lubricant 57. In particular, increase in drive torque of fixation belt 54 by the time of start of rotation of fixation belt 54 is suppressed. Therefore, wear of fixation belt 54 and pressing member 55 is suppressed. In an example where a slide sheet is provided between fixation belt 54 and pressing member 55, wear of the slide sheet is suppressed. Thus, fixation apparatus 50 can have fixation belt 54 rotate in a stable manner and consequently failure in transportation of paper or misalignment in printing is rectified.

(Comparison Result 2)

Figure 7:
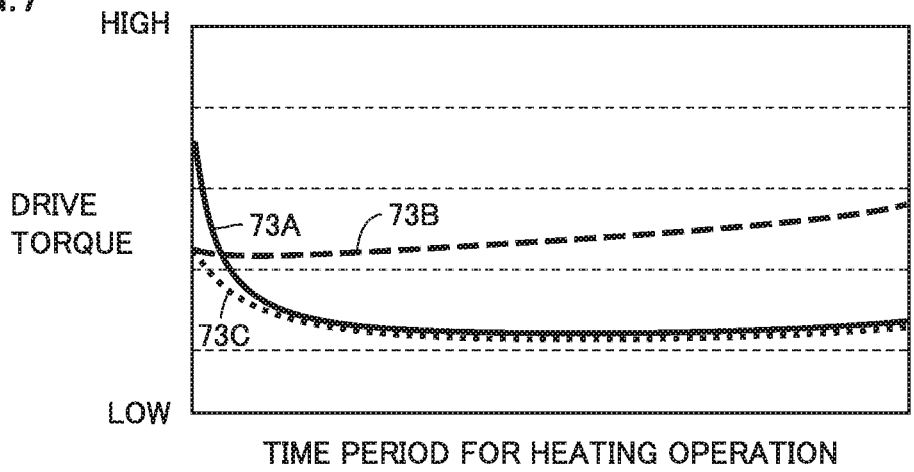
FIG. 7 is a diagram showing relation between a time period for a heating operation by a fixation apparatus according to the first embodiment and drive torque of the fixation belt.

Fixation apparatus 50 is evaluated from a different point of view with reference to FIG. 7. FIG. 7 is a diagram showing relation between a time period for a heating operation by fixation apparatus 50 and drive torque of fixation belt 54.

A comparison result 73A shown in FIG. 7 shows transition of drive torque of fixation belt 54 when an amount of application of lubricant 57 is set to 5.0 g in both of a case that fixation belt 54 is rotating and a case that fixation belt 54 remains stopped. A comparison result 73B shown in FIG. 7 shows transition of drive torque of fixation belt 54 when an amount of application of lubricant 57 is set to 0.5 g in both of a case that fixation belt 54 is rotating and a case that fixation belt 54 remains stopped. A comparison result 73C shown in FIG. 7 shows transition of drive torque in fixation apparatus 50 according to the present embodiment. Comparison result 73C shows transition of drive torque of fixation belt 54 in an example where an amount of application of lubricant 57 while fixation belt 54 is rotating is set to 5.0 g and an amount of application of lubricant 57 while fixation belt 54 remains stopped is set to 0.5 g.

As shown in comparison result 73A, when an amount of application of lubricant 57 is constantly large, drive torque of fixation belt 54 is high at the time of start of operation of fixation apparatus 50 and gradually lowers as a time period of operation of fixation apparatus 50 is longer. When it takes long time until drive torque is stabilized, it takes time until rotation of fixation belt 54 is stabilized.

As shown in comparison result 73B, when an amount of application of lubricant 57 is constantly small, drive torque of fixation belt 54 is low at the time of start of operation of fixation apparatus 50. Drive torque of fixation belt 54, however, gradually increases as a time period of operation of fixation apparatus 50 is longer. Therefore, rotation of fixation belt 54 is not stabilized.

As shown in comparison result 73C, when an amount of application of lubricant 57 is small while fixation belt 54 remains stopped and is large while fixation belt 54 is rotating, drive torque of fixation belt 54 is lower than in comparison result 73A from start of operation of fixation apparatus 50. Furthermore, in comparison result 73C, drive torque of fixation belt 54 is stabilized in a stage earlier than in comparison result 73A. Thus, fixation apparatus 50 according to the present embodiment can achieve suppressed drive torque at the time of start of rotation of fixation belt 54 and in addition, rotation of fixation belt 54 can be stabilized in an early stage.

Second Embodiment

[Overview]

Figure 8:
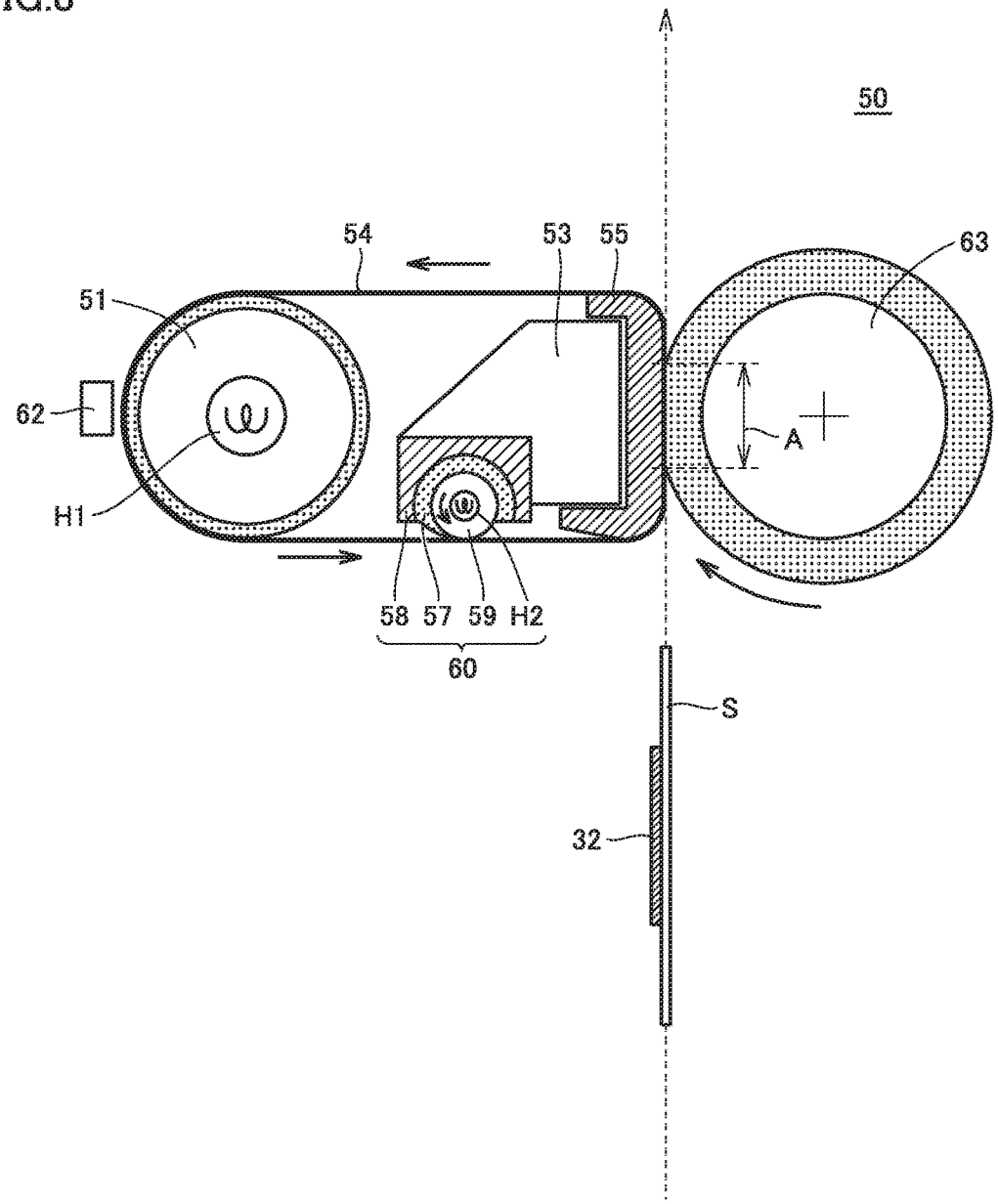
FIG. 8 is a diagram showing an internal structure of the fixation apparatus according to a second embodiment.

Fixation apparatus 50 according to a second embodiment will be described with reference to FIG. 8. FIG. 8 is a diagram showing an internal structure of fixation apparatus 50 according to the second embodiment.

Fixation apparatus 50 according to the second embodiment is different from fixation apparatus 50 according to the first embodiment in that a heater H2 (heat source) is provided in adjustment roller 59. Since fixation apparatus 50 according to the second embodiment is otherwise the same as fixation apparatus 50 according to the first embodiment, description thereof will not be repeated below.

[Control of Heater H2]

Figure 9:
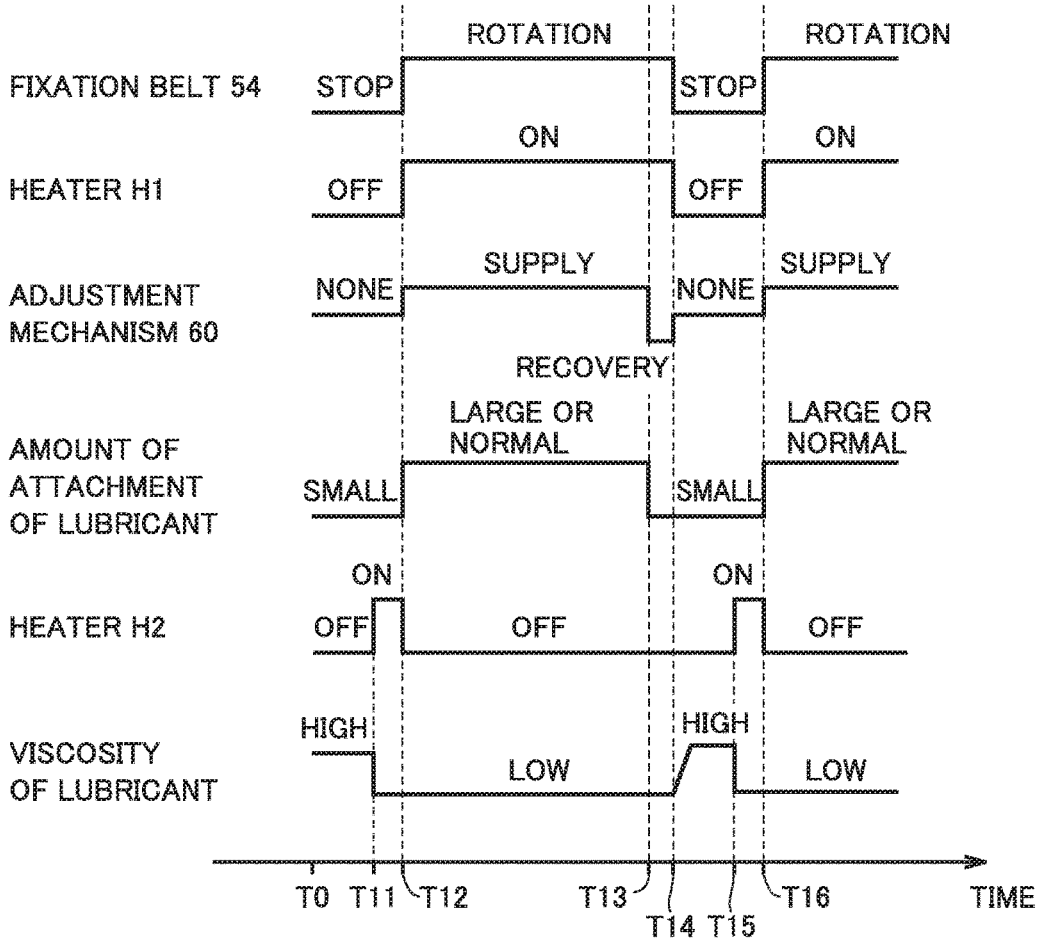
FIG. 9 is a diagram for illustrating timing of heating by a heater.

Timing of heating by heater H2 shown in FIG. 8 will be described with reference to FIG. 9. FIG. 9 is a diagram for illustrating timing of heating by heater H2.

At time T0, fixation apparatus 50 (see FIG. 8) has rotation of fixation belt 54 (see FIG. 8) stopped. Adjustment mechanism 60 (see FIG. 8) does not supply and recover lubricant 57 (see FIG. 8) while fixation belt 54 is not rotating.

At time T11, image formation apparatus 100 (see FIG. 1) accepts a print instruction. Based thereon, fixation apparatus 50 starts heating by heater H2. Heater H2 heats lubricant 57 before fixation belt 54 starts rotation. As lubricant 57 is heated, a viscosity of lubricant 57 lowers. Based on increase in temperature of lubricant 57 to a target temperature, fixation apparatus 50 stops heating by heater H2.

At time T12, fixation apparatus 50 starts rotation of fixation belt 54. Adjustment mechanism 60 supplies lubricant 57 to the inner circumferential surface of fixation belt 54 based on start of rotation of fixation belt 54. Since the viscosity of lubricant 57 has become low by this time, fixation apparatus 50 can achieve a lower slide resistance between fixation belt 54 and pressing member 55 from immediately after start of rotation of fixation belt 54.

At time T13, print processing by image formation apparatus 100 ends. Adjustment mechanism 60 recovers lubricant 57 from the inner circumferential surface of fixation belt 54 before rotation of fixation belt 54 stops.

At time T14, a process for recovery of lubricant 57 by adjustment mechanism 60 ends. Based on the end of the process for recovery of lubricant 57, fixation apparatus 50 stops rotation of fixation belt 54.

At time T15, image formation apparatus 100 accepts a new print instruction. Based on acceptance of a new print instruction by image formation apparatus 100, fixation apparatus 50 performs again the processing performed from time T11 to time T14.

[Control Structure of Image Formation Apparatus 100]

Figure 10:
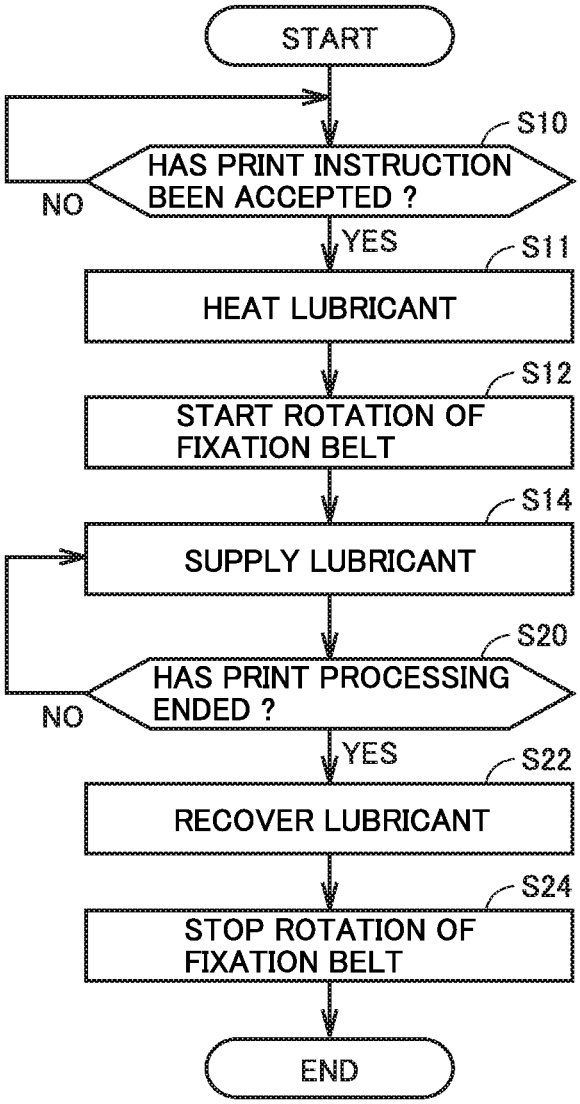
FIG. 10 is a flowchart showing a part of processing performed by the image formation apparatus according to the second embodiment.

A control structure of image formation apparatus 100 according to the second embodiment will be described with reference to FIG. 10. FIG. 10 is a flowchart showing a part of processing performed by image formation apparatus 100 according to the second embodiment. A process in FIG. 10 is implemented by execution of a program by control device 101 (see FIG. 5) of image formation apparatus 100. In another aspect, a part or the entirety of the process may be performed by a circuit element or other hardware. Since processing other than the processing in step S11 shown in FIG. 10 is as described with reference to FIG. 4, description of the processing will not be repeated.

In step S11, control device 101 starts heating of lubricant 57 by heater H2 (see FIG. 8). A process for heating lubricant 57 is performed before rotation of the fixation belt is started. Thus, a viscosity of lubricant 57 becomes low. Based on increase in temperature of lubricant 57 to a target temperature, control device 101 stops heating by heater 112.

[Summary]

As set forth above, fixation apparatus 50 according to the present embodiment includes heater H2 for heating lubricant 57. Fixation apparatus 50 increases a temperature of lubricant 57 by starting heating by heater H2 before fixation belt 54 starts rotation. Thus, a viscosity of lubricant 57 becomes low so that fixation apparatus 50 can achieve lowering in slide resistance between fixation belt 54 and pressing member 55 from immediately after start of rotation of fixation belt 54. Consequently, fixation apparatus 50 can further stabilize rotation of fixation belt 54.

Though the embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A fixation apparatus configured to fix a toner image transferred to paper to the paper with heat, the fixation apparatus comprising:

a rotatable belt;

a pressurization roller configured to be in contact with an outer circumferential surface of the belt and to rotate the belt;

a pressing member configured to face the pressurization roller with the belt being interposed therebetween and to press the belt against the pressurization roller;

a heating roller configured to provide heat to the paper which passes through a portion of contact between the belt and the pressurization roller by providing heat to the belt; and an adjustment mechanism configured to adjust an amount of attachment of a lubricant to an inner circumferential surface of the belt, wherein the adjustment mechanism includes:

a holding mechanism configured to hold the lubricant; and an adjustment roller configured to be in contact with the lubricant and the inner circumferential surface of the belt and to rotate in a direction identical to the belt in a portion of contact with the inner circumferential surface of the belt, wherein the adjustment mechanism is configured to adjust the amount of attachment of the lubricant to the inner circumferential surface of the belt such that an attached amount of the lubricant while the belt remains stopped is smaller than an attached amount of the lubricant during rotation of the belt, wherein the adjustment mechanism recovers the lubricant attached to the inner circumferential surface of the belt before the belt stops rotation, and wherein the adjustment roller supplies the lubricant to the inner circumferential surface of the belt by rotating faster than the belt and recovers the lubricant supplied to the inner circumferential surface of the belt by rotating slower than the belt.

2. The fixation apparatus according to claim 1, wherein the adjustment mechanism supplies the lubricant to the inner circumferential surface of the belt based on start of rotation of the belt.

3. The fixation apparatus according to claim 1, wherein the adjustment mechanism recovers the lubricant supplied to the inner circumferential surface of the belt such that the lubricant does not remain in the portion of contact when the belt stops rotation.

4. The fixation apparatus according to claim 1, wherein a first distance is shorter than a second distance, where a length of the belt on a side of a direction of rotation between a portion of contact between the adjustment mechanism and the belt and a portion of contact between the pressing member and the belt is defined as the first distance and a length of the belt on a side of a direction of reverse rotation between the portion of contact between the adjustment mechanism and the belt and the portion of contact between the pressing member and the belt is defined as the second distance.

5. The fixation apparatus according to claim 1, wherein the adjustment roller recovers the lubricant supplied to the inner circumferential surface of the belt by stopping rotation.

6. The fixation apparatus according to claim 1, wherein the adjustment roller contains a heat source.

7. The fixation apparatus according to claim 6, wherein the heat source heats the lubricant before the belt starts rotation.

8. An image formation apparatus comprising the fixation apparatus according to claim 1.

9. A non-transitory recording medium storing a control program for controlling a fixation apparatus that is configured to fix a toner image transferred to paper to the paper with heat, the fixation apparatus including a rotatable belt, a pressurization roller configured to be in contact with an outer circumferential surface of the belt and to rotate the belt, a pressing member configured to face the pressurization roller with the belt being interposed therebetween and to press the belt against the pressurization roller, a heating roller configured to provide heat to the paper which passes through a portion of contact between the belt and the pressurization roller by providing heat to the belt, a holding mechanism configured to hold lubricant, and an adjustment roller configured to be in contact with the lubricant and an inner circumferential surface of the belt and to rotate in a direction identical to the belt in a portion of contact with the inner circumferential surface of the belt, the program controlling the fixation apparatus to perform functions comprising:

supplying the lubricant to the inner circumferential surface of the belt based on start of rotation of the belt by rotating the adjustment roller faster than the belt; and recovering the lubricant supplied to the inner circumferential surface of the belt before the belt stops rotation by rotating the adjustment roller slower than the belt, wherein the recovering the lubricant includes adjusting an amount of attachment of the lubricant to the inner circumferential surface of the belt before the belt stops rotation such that an attached amount of the lubricant while the belt remains stopped is smaller than an attached amount of the lubricant during rotation of the belt.

10. The non-transitory recording medium according to claim 9, wherein the recovering the lubricant includes recovering the lubricant supplied to the inner circumferential surface of the belt such that the lubricant does not remain in the portion of contact when the belt stops rotation.

11. The non-transitory recording medium according to claim 9, wherein:

the fixation apparatus includes an adjustment mechanism, the adjustment mechanism including the holding mechanism and the adjustment roller, and a first distance is shorter than a second distance, where a length of the belt on a side of a direction of rotation between a portion of contact between the adjustment mechanism and the belt and a portion of contact between the pressing member and the belt is defined as the first distance and a length of the belt on a side of a direction of reverse rotation between the portion of contact between the adjustment mechanism and the belt and the portion of contact between the pressing member and the belt is defined as the second distance.

12. The non-transitory recording medium according to claim 9, wherein the recovering the lubricant includes recovering the lubricant supplied to the inner circumferential surface of the belt by stopping rotation of the adjustment roller.

13. The non-transitory recording medium according to claim 9, wherein the adjustment roller contains a heat source.

14. The non-transitory recording medium according to claim 13, wherein the heat source heats the lubricant before the belt starts rotation.

15. The non-transitory recording medium according to claim 9, wherein the fixation apparatus is mounted on an image formation apparatus.

* * * * *